US006743061B2

(12) United States Patent
Jaegerskuepper

(10) Patent No.: US 6,743,061 B2
(45) Date of Patent: Jun. 1, 2004

(54) ELECTRICAL CONNECTION OR JUNCTION DEVICE

(75) Inventor: Raimund Jaegerskuepper, Steinheim (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 0 days.

(21) Appl. No.: 10/194,490

(22) Filed: Jul. 12, 2002

(65) Prior Publication Data

US 2003/0032341 A1 Feb. 13, 2003

(30) Foreign Application Priority Data

Jul. 19, 2001 (DE) ..... 101 34 417

(51) Int. Cl.[7] ..... H01R 4/48
(52) U.S. Cl. ..... 439/834; 439/835
(58) Field of Search ..... 439/439, 828, 439/834, 835, 838

(56) References Cited

U.S. PATENT DOCUMENTS

| | | | | | |
|---|---|---|---|---|---|
| 4,171,861 | A | * | 10/1979 | Hohorst | 439/94 |
| 4,767,340 | A | * | 8/1988 | Hohorst | 439/729 |
| 5,860,837 | A | * | 1/1999 | Bock et al. | 439/828 |
| 5,938,484 | A | * | 8/1999 | Beege et al. | 439/828 |
| 5,954,535 | A | * | 9/1999 | Lawrence | 439/439 |
| 6,155,890 | A | * | 12/2000 | Gerberding | 439/835 |
| 6,283,801 | B1 | * | 9/2001 | Guinda et al. | 439/835 |

FOREIGN PATENT DOCUMENTS

| | | | | | |
|---|---|---|---|---|---|
| DE | 4237733 | C1 | * | 12/1993 | H01R/4/48 |
| DE | 4231244 | A1 | * | 3/1994 | H01R/4/48 |
| DE | 19626390 | A1 | * | 1/1997 | H01R/4/48 |
| DE | 19715971 | C1 | * | 5/1998 | H01R/4/48 |
| DE | 19711051 | A1 | * | 9/1998 | H01R/4/48 |
| DE | 19805903 | C1 | * | 7/1999 | H01R/4/48 |
| DE | 19810310 | C1 | * | 7/1999 | H01R/4/48 |

* cited by examiner

*Primary Examiner*—Renee Luebke
*Assistant Examiner*—Ann McCamey
(74) *Attorney, Agent, or Firm*—Charles E. Baxley

(57) ABSTRACT

An electrical connection or junction device. An insulation housing (2) has two conductor insertion apertures (3, 13) for insertion of two electrical conductors (4, 14) to be connected and two actuation apertures (5, 15) for insertion of an actuating tool to open tension springs (2, 12). Tension springs (2, 12) each have a clamping arm (6, 16) with a cutaway (7, 17) to allow insertion of the electrical conductor (4, 14) to be connected, a bearing arm (8, 18) extends approximately perpendicularly to the clamping arm (6, 16), and a spine (9, 19) connects the clamping arm (6, 16) and the bearing arm (8, 18). The two tension springs (2, 12) are arranged at an angle of approximately 180° to one another, so that the two bearing arms (8, 18) are arranged with their bottom sides (10, 20) facing one another, the clamping arms (6, 16) overlap each other, and the cutaways (7, 17) at least partially cover each other when the tension springs (2, 12) are opened.

17 Claims, 4 Drawing Sheets

ELECTRICAL CONNECTION OR JUNCTION DEVICE

BACKGROUND OF THE INVENTION

1. Field of the Invention

The present invention relates to an electrical connection or junction device having an insulation housing and at least two tension springs, wherein the insulation housing is furnished with at least two conductor insertion apertures for the insertion of at least two electrical conductors to be connected and at least two actuation apertures for the insertion of an actuating tool that is used to open the tension springs, with the tension springs being each furnished with a clamping arm having a cutaway to allow insertion of the electrical conductor to be connected, a bearing arm that extends approximately perpendicularly to the clamping arm, and a spine connecting the clamping arm and the bearing arm. More particularly, the present invention further relates to an arrangement of at least two tension springs, each of which being furnished with a clamping arm having a cutaway allowing insertion of an electrical conductor for connection, a bearing arm extending approximately perpendicularly to the clamping arm, and a spine connecting the clamping arm and the bearing arm.

2. Description of the Prior Art

Electrical connection or junction devices are used to establish an electrical connection or junction, specifically an electrically conductive connection, and more specifically a galvanic connection, between a contact element and a counterpart contact element. For functional purposes, the distinction between a connection device and a junction device is relatively unimportant. The term connection device is frequently used to refer to a device in which a movable device is connected to a fixed device, and a junction device is the term used for a connection between two movable or fixed devices.

The electrical connection or junction devices described above are often also called tension spring clamps due to the nature of the connection principle. The essential components of these kinds of electrical clamps are the tension springs, which are loop-shaped clamp springs, and of which a wide variety of different configurations and designs are known. In this context, the following patents are cited, for example: DE 196 26 390 C2, DE 197 11 051 A1, DE 197 15 971 C1, DE 198 05 903 C1, or DE 198 10 310 C1. Consequently, all configurations of loop-shaped clamp springs that are known from the prior art, particularly from the patents cited above, fall under the generic term "tension spring".

Over the course of time, tension spring clamps have become established on the market alongside screw clamps, and more recently also alongside electrical clamps with strip-and-connect technology, and which are used in the millions, particularly as series clamps. The advantage of tension spring clamps over screw clamps lies in the fact that tension spring clamps allow wiring to be done more quickly and more easily. In order to actuate the tension spring clamp, all that is needed is an actuating tool, for example a screwdriver, which is pressed into the actuating channel to open the clamp. The blade of the screwdriver biases the tension spring, so that a clamping point opens. A conductor to be connected can then be inserted through the cutaway into the clamp arm, and when the screwdriver is withdrawn the conductor is then clamped by the underside of the cutaway against the bearing arm of the tension spring or a busbar connected to the tension spring. Tension spring clamps are known in a wide range of configurations, particularly as series clamps, and are usually locked onto a hat-shaped bearing rail.

As switching cabinets, whose main purpose is to accommodate the tension spring clamps and other electrical clamps in common use have shrunk in size, so do the tension spring clamps have to also become smaller. Many suggestions have already been made for reducing the surface area of the electrical clamp or for providing the largest possible number of connection possibilities on the smallest possible surface area.

For example, a tiered clamp for electrical conductors is taught by DE 40 19 130 A1, in which multiple tension springs are disposed one above the other, and which may be opened individually using an actuating tool that is inserted into the connection clamp from above. Additionally, two-tier tension spring clamps or three-tier tension spring clamps are known in which the individual tension springs are disposed in a stepped arrangement.

SUMMARY OF THE INVENTION

Accordingly, an object of the present invention is to provide an electrical connection or junction device and to provide an arrangement including at least two tension springs that allow a further reduction in size, but which may still be manufactured simply and thus as inexpensively as possible.

The object underlying the present invention is solved by the electrical connection or junction device due to the fact that two tension springs are arranged at an angle of approximately 180 degrees with respect to one another, so that the spines of the two bearing arms of the tension springs are facing one another, and the clamping arms of the two tension springs overlap each other, and the cutaways in the clamping arms at least partially cover each other when the tension springs are opened. Thus, the fact that the two tension springs are arranged at an angle of 180° to one another means that the two tension springs are in a mirroring arrangement with respect to each other. The effect of the arrangement of the two bearing arms with their spines facing one another is that the tension springs are also offset by 180° with respect to the known arrangements.

The electrical connection or junction device according to the present invention thus has at least one "dual connection", which is created from the two "cooperating" tension springs. Because the clamping arms of the two tension springs overlap and the cutaways at least partially cover each other when the tension springs are opened, not only the conductor to be contacted through the tension spring in question, but also the conductor to be contacted through the other tension, are advanced through the two cutaways of the tension springs. The first electrical conductor is clamped by the first tension spring against the upper side of the bearing arm of the second tension spring. Thus, an electrical connection or junction device configured in this way establishes an electrical connection between two conductors inserted into the two tension springs.

According to a first embodiment of the present invention, the electrical connection or junction device is furnished with at least one bearing rail, which is conductively connected to the tension springs. The provision of a bearing rail of such kind represents a simple method to create a junction clamp that connects one or more inputs with one or more outputs. If the electrical connection orjunction device is furnished with the "dual connection" created by the tension springs according to the present invention, both at the input side and at the output side, a highly compact four-wire tension spring clamp may be produced. Of course it is also possible to provide more than one "dual connection", both at the input side and the output side of the tension spring clamp, and the number of "dual connections" may be different on the two sides.

If the electrical connection or junction device according to the present invention is furnished with a bearing rail, there are a number of possible ways to connect this bearing rail conductively to the tension springs. According to a first and particularly easily realized variant, the bearing rail is disposed between the two bearing arms of the two tension springs. This means that the bearing rail may only be advanced between the two bearing arms of the two tension springs and may only contact the bearing arms through the elastic force of the two tension springs. In this variant, the tension springs are then secured in the insulation housing while the position of the bearing rail is secured in position by the two tension springs. Alternatively or additionally, however, the bearing rail may also be connected by welding or soldering to the bearing arms of the tension springs.

Besides the option to dispose the bearing bar between the two bearing arms of the tension springs, it is also possible to arrange the bearing bar on one side of at least one tension spring, in which arrangement the bearing bar may be connected either directly or indirectly to one or both tension springs via a connecting element. This arrangement of the bearing bar either directly or indirectly connected to a bearing arm of a tension spring via a connecting element may be easily achieved since the bearing arm represents the fixed part of the tension spring. The clamping arm and the spine of the tension spring must be movably disposed so that the tension spring is capable of being opened.

If the bearing rail is connected to the tension spring via a connecting member, the end of the connecting member distal to the tension spring may have the form of a clamping spring contact, particularly a fork spring or a U-spring. In this way, it is possible to insert a bearing rail into the end of the connecting member that is conformed as a clamping spring contact, which rail may then serve as a busbar, and via which multiple adjacently arranged tension spring clamps may be driven with a shared potential.

The electrical connection or junction device according to the present invention may be produced easily if the tension springs are connected together in a single unit. For example, the two tension springs that are arranged at an angle of 180° with respect to one another may have a single shared bearing arm. In this way, the upper surface of the bearing arm serves as a contact for one conductor and the lower surface serves as a contact for the other. The electrical connection or junction device may be constructed simply and inexpensively if identically conformed tension springs are used. Then the two tension springs may be connected to one another via the ends of the bearing arms or via a lateral edge of the bearing arms. The two tension springs may then be punched out of an elastic sheet material and bent into their final shape.

The insulation housing for accommodating the tension springs may be conformed differently depending on the use and field of application of the electrical connection or junction device. In particular, the insulation housing may include a locking arrangement for securing the electrical connection or junction device on a busbar. The insulation housing is also usually equipped with latching pins and snap-in holes, which allow several electrical connection or junction devices to be locked together to form a clamp block. For a detailed description of housing forms known from the state of the art, see for example the housing forms in applicant's product catalogue "CLIPLINE 2000 Modular Terminal Blocks", particularly on pages 230 to 239. Of course only the minimal space requirement entailed by the arrangement of the tension springs according to the present invention is taken into account for purposes of constructing the insulation housing.

In particular, it is clear from the above that the essential inventive element of the electrical connection or junction device of the present invention is the arrangement and configuration of the tension springs. Accordingly, the present invention relates not only to an electrical connection or junction device having an insulation housing and having at least two tension springs, but also to an arrangement of at least two tension springs. The object of the present invention is solved in the arrangement of the tension springs by the fact that the two tension springs are arranged at an angle of approximately 180 degrees with respect to one another, so that the two bearing arms are disposed with their undersides facing each other, wherein the clamping arms of the two tension springs overlap, and the cutaways in the clamping arms cover one another at least partially when the tension springs are in the open state.

There is a wide range of options for varying individual elements in order to improve and refine the electrical connection or junction device and the arrangement of two or more tension springs according to the present invention.

DETAILED DESCRIPTION OF THE PREFERRED EMBODIMENTS

Figure 1:
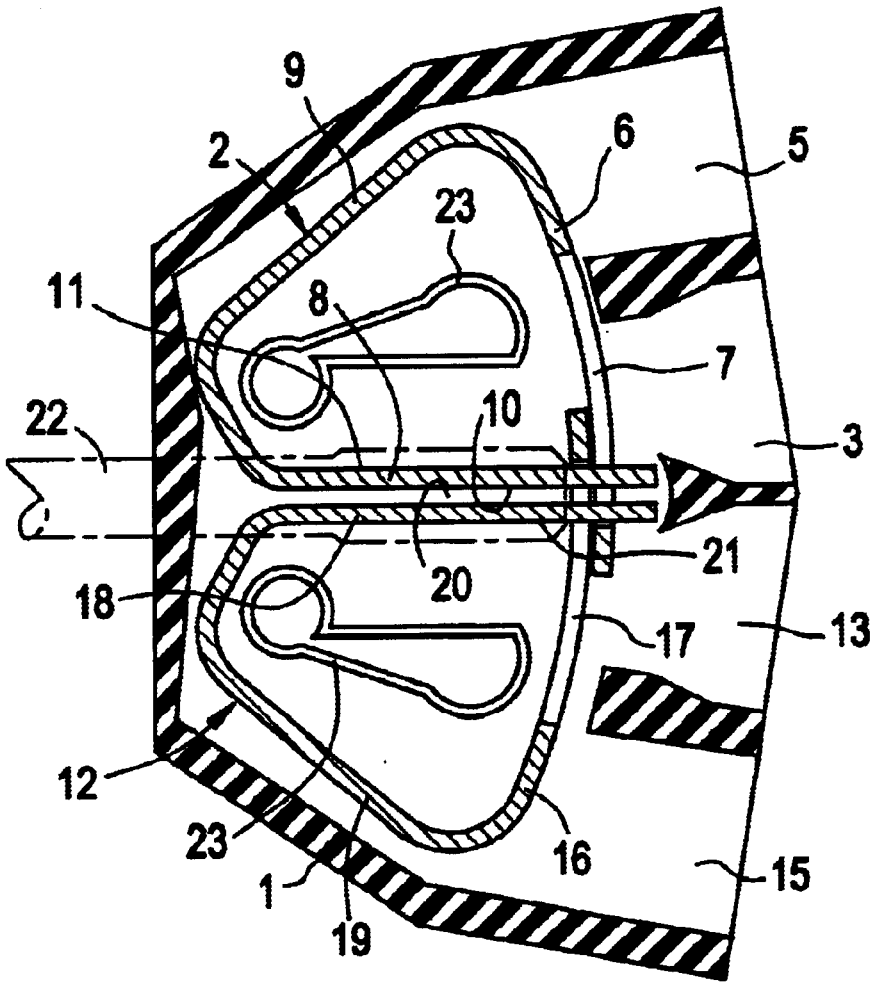
FIG. 1 is a diagrammatic cross sectional view of an embodiment of an electrical connection or junction device having two tension springs arranged in an insulation housing.

Referring now to the figures, in which like numerals indicate like parts, FIG. 1 shows two tension springs 2, 12 arranged in an insulation housing 1. The insulation housing 1 is furnished with two conductor insertion apertures 3, 13 for insertion of two electrical conductors 4, 14 to be connected (see FIG. 4) and two actuation apertures 5, 15 to accommodate an actuating tool (not shown). The two tension springs 2, 12 each include a clamping arm 6, 16, in which a cutaway 7, 17 is provided, a bearing arm 8, 18 extending more or less perpendicularly to the clamping arm 6, 16, and a spine 9, 19 connecting the clamping arm 6, 16 and the bearing arm 8, 18.

The electrical conductor 4, 14 is connected in a manner known in the art for tension spring clamps in that an actuating tool (not shown), for example the blade of a screwdriver, is first inserted into the actuation aperture 5, 15, during which operation the actuation tool (not shown) is guided by alignment of the actuation aperture 5, 15 in such a manner that the blade of the actuation tool (not shown)

passes between the spines 9, 19 of the tension springs 2, 12 and the insulation housing 1. This causes the tension springs 2, 12 to be compressed, so that the cutaways 7, 17 in the clamping arms 6, 16 are displaced behind the conductor insertion apertures 3, 13 in such a manner that conductors 4, 14 to be connected may be advanced through the conductor insertion apertures 3, 13 and through the cutaways 7, 17 into the tension springs 2, 12. According to the state of the art, the electrical conductors 4, 14 are now brought into contact by the fact that when the actuation tool (not shown) is withdrawn from the actuation apertures 5, 15, the electrical conductors 4, 14 inserted into the cutaways 7, 17 are forced from below into contact with the bearing arms 8, 18.

In the arrangement shown in FIG. 1, the clamping arm 6, and thus also the cutaway 7, of the tension spring 2 is pressed downwards by the actuating tool (not shown), which causes the tension spring 2 to be biased against its elastic force. When the actuating tool (not shown) is withdrawn, the clamping arm 6, and thus also the conductor 4 inserted in the cutaway 7, snaps rapidly upwards. Since the two tension springs 2, 12 are arranged at an angle of 180 degrees with respect to each other in such manner that undersides 10, 20 of the two bearing arms 8, 18 of the two tension springs 2, 12 are facing each other, the conductor 4 is then biased towards upper side 21 of the clamping arm 16 of the second tension spring 12.

In the electrical connection or junction device according to the present invention, the two tension springs 2, 12 cooperate in such a manner that the conductor 4 that is inserted into the cutaway 7 of the tension spring 2 is clamped against the upper side 21 of the clamping arm 16 of the other tension spring 12. Similarly, the second conductor 14 that is advanced into the cutaway 17 of the second tension spring 12 is pressed against upper side 11 of the bearing arm 8 of the first tension spring 2 by the clamping arm 16 of the second tension spring 12.

Figure 4:
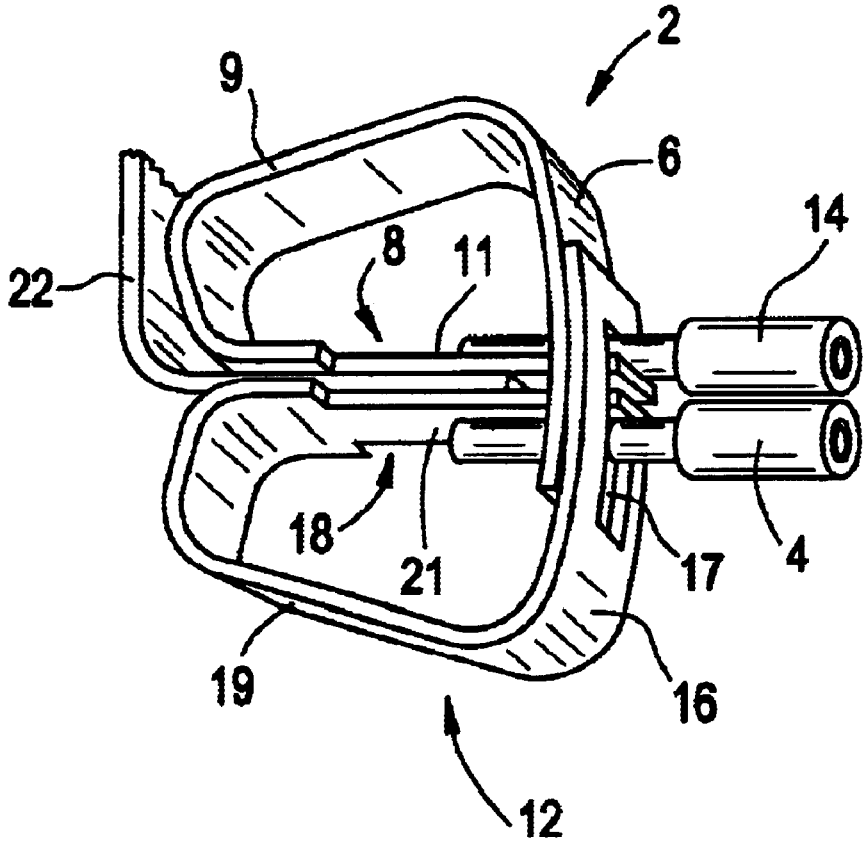
FIG. 4 is a diagrammatic perspective view of a third embodiment of two tension springs of the present invention, with inserted conductors.

The cutaways 7, 17 in the clamping arms 6, 16 are of such a size that they not only allow opening lift for clamping the one conductor 4, 14, but they also provide clearance for the conductor 14,4 contacted through the other tension spring 12,2. FIG. 4 shows that the size of the cutaway 17 in the clamping arm 16 is selected such that it is possible to open the tension spring 12 and so withdraw the conductor 14 from the cutaway 17 or insert it thereinto, even when the conductor 4 contacted through the other tension spring 2 is advanced into the cutaway 17 and also into the cutaway 7. Thus, the cutaways 7, 17 in the clamping arms 6, 16 are at least marginally larger than the diameter of the two electrical conductors 4, 14. Unlike the tension springs known from the prior art, in the case of the tension springs 2, 12 configured and arranged according to the present invention, not only the conductor 4, 14 is advanced to be contacted through the associated tension spring 2, 12 into the respective cutaway 7, 17, but the other conductor 14, 4 is likewise advanced for contacting through the other tension spring 12, 2.

In the embodiments shown in FIGS. 1 to 4, the tension springs 2, 12 are connected conductively to a busbar 22. In the configuration according to FIG. 1, the busbar 22 is disposed laterally on the bearing arms 8, 18 and in the embodiment according to FIG. 4 it is situated between the two bearing arms 8, 18 of the tension springs 2, 12. FIG. 1 further shows that a stopping element 23 is provided in the interior of each of the tension springs 2, 12. The two stopping elements 23 serve as overload protection for the two tension springs 2, 12, thereby ensuring that the tension springs 2, 12 are not damaged when the actuating tool (not shown) is inserted into the actuation apertures 5, 15. The stopping element 23 may be conformed as an integral part of the insulation housing 1 or be provided as a separate component inside the insulation housing 1.

Figure 2:
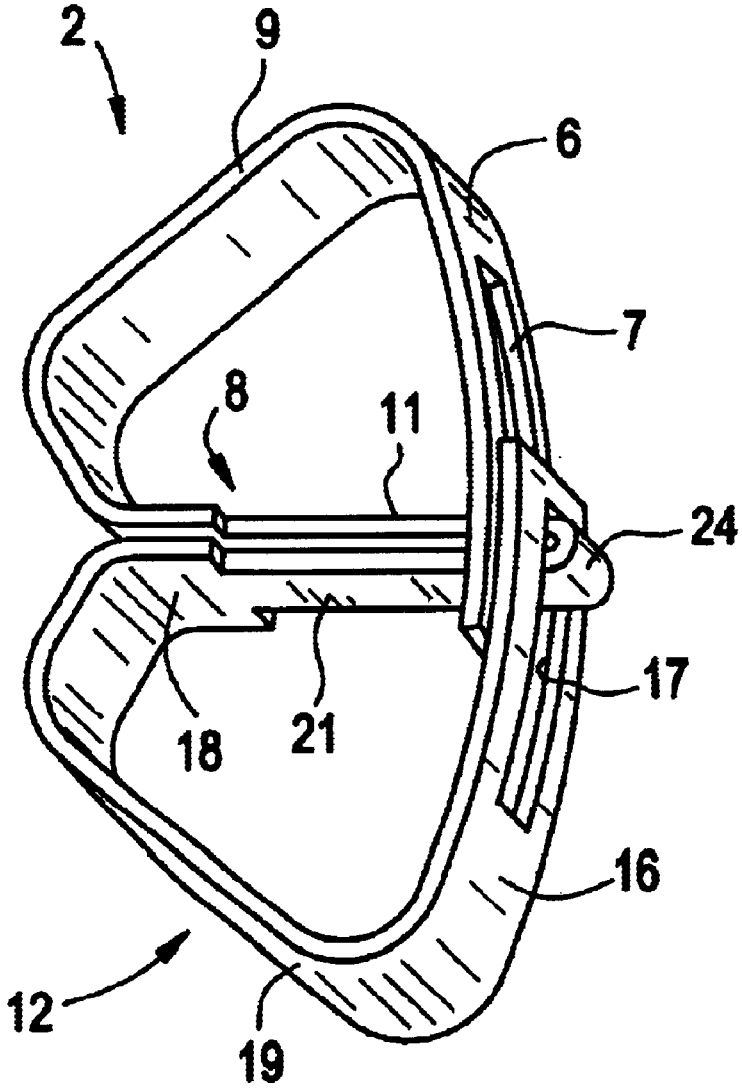
FIG. 2 is a diagrammatic perspective view of two tension springs according to a first embodiment of the present invention, with no inserted conductors.
Figure 3:
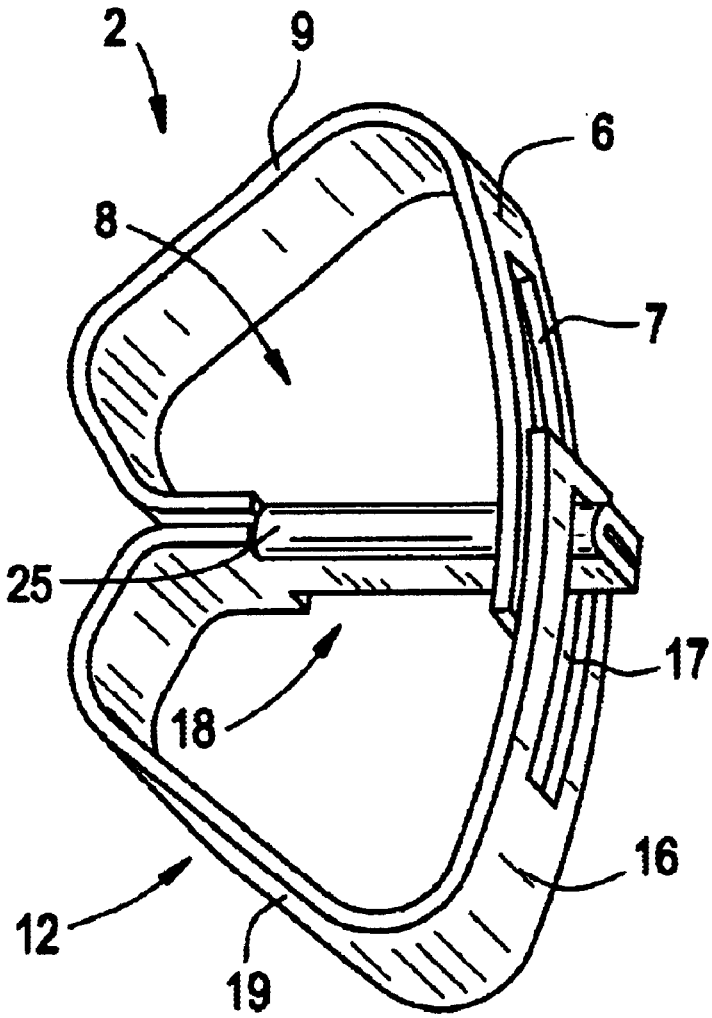
FIG. 3 is a diagrammatic perspective view of two tension springs according to a second embodiment of the present invention, with no inserted conductors.

FIGS. 2 and 3 show an arrangement according to the present invention of the two tension springs 2, 12, in which the two tension springs 2, 12 are conformed together as a single unit. In the configuration shown in FIG. 2, extremities 24 of bearing arms 8, 18 are connected together, whereas in the configuration according to FIG. 3, the bearing arms 8, 18 of the two tension springs 2, 12 are connected together via a lateral edge 25. Regardless of whether the tension springs 2, 12 are conformed as a single unit, they may be produced very simply by punching out and bending, and this process may be further simplified if the tension springs 2, 12, as illustrated in all the Figures, are identically conformed in all particulars.

What is claimed is:

1. An improved electrical connection or junction device having an insulation housing (1) and at least two tension springs (2, 12), wherein the insulation housing (1) is furnished with at least two conductor insertion apertures (3, 13) for insertion of at least two electrical conductors (4, 14) to be connected and at least two actuation apertures (5, 15) for insertion of an actuating tool to open the tension springs (2, 12), and wherein the tension springs (2, 12) have bottom sides (10, 20) and are each furnished with a clamping arm (6, 16) having a cutaway (7, 17) for insertion of the electrical conductor (4, 14) to be connected, a bearing arm (8, 18) that extends approximately perpendicularly to the clamping arm (6, 16), and a spine (9, 19) connecting the clamping arm (6, 16) and the bearing arm (8, 18), wherein the improvement comprises the two tension springs (2, 12) being arranged at an angle of approximately 180 degrees with respect to one another causing the two tension springs (2, 12) to be mirror images of each other so as to allow the two bearing arms (8, 18) of the tension springs (2, 12) to be arranged with the, bottom sides (10, 20) thereof facing one another, and so as to allow the clamping arms (6, 16) of the two tension springs (2, 12) to overlap each other, and so as to allow the cutaways (7, 17) in the clamping arms (6, 16) to at least partially cover each other when the tension springs (2, 12) are opened.

2. The electrical connection orjunction device according to claim 1, wherein at least one busbar (22) is provided that is conductively connected to the tension springs (2, 12).

3. The electrical connection or junction device according to claim 2, wherein the busbar (22) is arranged between the two bearing arms (8, 18) of the tension springs (2, 12).

4. The electrical connection or junction device according to claim 2, wherein the busbar (22) is attached directly or indirectly via a connecting member to a side of at least one tension spring (2, 12), particularly to a bearing arm (8, 18) of a tension spring (2, 12).

5. The electrical connection orjunction device according to claim 4 further having a connecting member, wherein an end of the tension spring (2, 12) distal to the connecting member is configured as a clamping spring contact into which the busbar (22) may be plugged.

6. The electrical connection or junction device according to claim 1, 2, 3, 4, or 5, wherein the tension springs (2, 12) are formed together as a single unit.

7. The electrical connection or junction device according to claim 6, wherein extremities (24) of the bearing arms (8, 18) are connected together.

8. The electrical connection or junction device according to claim 6, wherein the bearing arms (8, 18) are connected together via a lateral edge (25).

9. The electrical connection or junction device according to claim 6, wherein both tension springs (2, 12) have a common bearing arm.

10. The electrical connection or junction device according to claim 1, 2, 3, 4, 5, 7, 8, or 9, wherein both tension springs (2, 12) are formed identically.

11. The electrical connection or junction device according to claim 6, wherein both tension springs (2, 12) are formed identically.

12. An improved arrangement of at least two tension springs (2,12) having a clamping arm (6, 16) with a cutaway (7, 17) for each tension spring (2, 12) for insertion of an electrical conductor (4, 14) to be connected, a bearing arm (8, 18) for each tension spring (2, 12) that extends approximately perpendicularly to the clamping arm (6, 16) and has a bottom side, and a spine (9, 19) for each tension spring (2, 12) connecting the clamping arm (6, 16) and the bearing arm (8, 18), wherein the improvement comprises the two tension springs (2, 12) being arranged at an angle of approximately 180 degrees with respect to one another causing the two tension springs (2, 12) to be mirror images of each other so as to allow the two bearing arms (8, 18) to be arranged with the bottom sides (10, 20) thereof facing one another, and so as to allow the clamping arms (6, 16) of the two tension springs (2, 12) to overlap each other, and so as to allow the cutaways (7, 17) in the clamping arms (6, 16) to at least partially cover each other when the tension springs (2, 12) are opened.

13. The arrangement of at least two tension springs according to claim 12, wherein at least one busbar (22) is provided that is conductively connected to the tension springs (2, 12).

14. The arrangement of at least two tension springs according to claim 12 or 13, wherein the two tension springs (2, 12) are identically formed and are formed together in a single unit.

15. An improved electrical connection or junction device having an insulation housing (1) and at least two tension springs (2, 12), wherein the insulation housing (1) is furnished with at least two conductor insertion apertures (3, 13) for insertion of at least two electrical conductors (4, 14) to be connected and at least two actuation apertures (5, 15) for insertion of an actuating tool to open the tension springs (2, 12), and wherein the tension springs (2, 12) have bottom sides (10, 20) and are each furnished with a clamping arm (6, 16) having a cutaway (7, 17) for insertion of the electrical conductor (4, 14) to be connected, a bearing arm (8, 18) that extends approximately perpendicularly to the clamping arm (6, 16), and a spine (9, 19) connecting the clamping arm (6, 16) and the bearing arm (8, 18), wherein the improvement comprises the two tension springs (2, 12) being arranged at an angle of approximately 180 degrees with respect to one another so as to allow the two bearing arms (8, 18) of the tension springs (2, 12) to be arranged with the bottom sides (10, 20) thereof facing one another, and so as to allow the clamping arms (6, 16) of the two tension springs (2, 12) to overlap each other, and so as to allow the cutaways (7, 17) in the clamping arms (6, 16) to at least partially cover each other when the tension springs (2, 12) are opened; wherein at least one busbar (22) is provided that is conductively connected to the tension springs (2, 12); wherein the busbar (22) is arranged between the two bearing arms (8, 18) of the tension springs (2, 12).

16. An improved electrical connection or junction device having an insulation housing (1) and at least two tension springs (2, 12), wherein the insulation housing (1) is furnished with at least two conductor insertion apertures (3, 13) for insertion of at least two electrical conductors (4, 14) to be connected and at least two actuation apertures (5, 15) for insertion of an actuating tool to open the tension springs (2, 12), and wherein the tension springs (2, 12) have bottom sides (10, 20) and are each furnished with a clamping arm (6, 16) having a cutaway (7, 17) for insertion of the electrical conductor (4, 14) to be connected, a bearing arm (8, 18) that extends approximately perpendicularly to the clamping arm (6, 16), and a spine (9, 19) connecting the clamping arm (6, 16) and the bearing arm (8, 18), wherein the improvement comprises the two tension springs (2, 12) being arranged at an angle of approximately 180 degrees with respect to one another so as to allow the two bearing arms (8, 18) of the tension springs (2, 12) to be arranged with the bottom sides (10, 20) thereof facing one another, and so as to allow the clamping arms (6, 16) of the two tension springs (2, 12) to overlap each other, and so as to allow the cutaways (7, 17) in the clamping arms (6, 16) to at least partially cover each other when the tension springs (2, 12) are opened; wherein at least one busbar (22) is provided that is conductively connected to the tension springs (2, 12); wherein the busbar (22) is attached directly or indirectly via a connecting member to a side of at least one tension spring (2, 12), particularly to a bearing arm (8, 18) of a tension spring (2, 12); further having a connecting member, wherein an end of the tension spring (2, 12) distal to the connecting member is configured as a clamping spring contact into which the busbar (22) may be plugged.

17. An improved arrangement of at least two tension springs (2,12) having a clamping arm (6, 16) with a cutaway (7, 17) for each tension spring (2, 12) for insertion of an electrical conductor (4, 14) to be connected, a bearing arm (8, 18) for each tension spring (2, 12) that extends approximately perpendicularly to the clamping arm (6, 16) and has a bottom side, and a spine (9, 19) for each tension spring (2, 12) connecting the clamping arm (6, 16) and the bearing arm (8, 18), wherein the improvement comprises the two tension springs (2, 12) being arranged at an angle of approximately 180 degrees with respect to one another so as to allow the two bearing arms (8, 18) to be arranged with the bottom sides (10, 20) thereof facing one another, and so as to allow the clamping arms (6, 16) of the two tension springs (2, 12) to overlap each other, and so as to allow the cutaways (1, 17) in the clamping arms (6, 16) to at least partially cover each other when the tension springs (2, 12) are opened; wherein the two tension springs (2, 12) are identically formed and are formed together in a single unit.

* * * * *